US006748896B2

(12) United States Patent
Hunsley

(10) Patent No.: US 6,748,896 B2
(45) Date of Patent: Jun. 15, 2004

(54) STREAMER FLAG ATTACHMENT

(76) Inventor: Barbara Hunsley, 108 Sea Breeze Ct., Emerald Isle, NC (US) 28594

( * ) Notice: Subject to any disclaimer, the term of this patent is extended or adjusted under 35 U.S.C. 154(b) by 0 days.

(21) Appl. No.: 10/127,748

(22) Filed: Apr. 22, 2002

(65) Prior Publication Data

US 2003/0196584 A1 Oct. 23, 2003

(51) Int. Cl.[7] ..... G09F 17/00
(52) U.S. Cl. ..... 116/173; 116/200; 116/174
(58) Field of Search ..... 116/173, 174, 116/200

(56) References Cited

U.S. PATENT DOCUMENTS

| | | | | | |
|---|---|---|---|---|---|
| 1,096,375 | A | * | 5/1914 | Joslyn | 116/173 |
| 2,506,197 | A | * | 5/1950 | Burger | 116/173 |
| 2,869,507 | A | | 1/1959 | Boyer | 116/173 |
| 3,036,545 | A | * | 5/1962 | Legg | 116/28 R |
| 4,055,840 | A | | 10/1977 | Uchytil et al. | 340/321 |
| 4,080,925 | A | | 3/1978 | Moore | 116/117 R |
| 4,813,369 | A | * | 3/1989 | Moreland | 116/173 |
| 4,876,981 | A | * | 10/1989 | Barnhart | 116/173 |
| 4,964,360 | A | | 10/1990 | Henry | 116/28 R |
| 5,070,809 | A | | 12/1991 | Fox et al. | 116/174 |
| D327,454 | S | | 6/1992 | Garbarino | D11/166 |
| D330,876 | S | | 11/1992 | Huber | D11/141 |
| 5,423,281 | A | | 6/1995 | Crookham et al. | 116/173 |
| 5,472,003 | A | * | 12/1995 | Frame et al. | 132/275 |
| 5,590,621 | A | | 1/1997 | Sectish | 116/173 |
| 5,622,337 | A | * | 4/1997 | Unruh | 244/142 |
| 5,694,733 | A | | 12/1997 | Gallemore, II | 52/736.2 |
| 5,810,318 | A | | 9/1998 | Federico | 248/539 |
| 5,943,980 | A | | 8/1999 | Huang | 116/174 |
| D440,184 | S | | 4/2001 | Jones et al. | D11/166 |
| 6,247,423 | B1 | * | 6/2001 | Ingram et al. | 116/28 R |

OTHER PUBLICATIONS

Catalog, Props & Bags, Etc., p. 6 2002 (wrist streamer, streamer on a stick), Date Unknown.
Web Catalog, Drill Team Exchange (Ribbons & Streamers), pp. 1 and 2, Dec. 25, 2001.
Web Catalog, West Coast Pageantry (Glory Hoops, Shimmer Rings, Ribbon Hoops).

* cited by examiner

*Primary Examiner*—Christopher W. Fulton
*Assistant Examiner*—Amanda J Hoolahan
(74) *Attorney, Agent, or Firm*—Kenneth Watov; Watov & Kipnes, P.C.

(57) ABSTRACT

A streamer flag attachment adapted for securement to a flag pole or a flagstaff, includes a circular loop of elastic material defining a central opening for receiving therethrough a portion of the flagstaff, a streamer holder adapted for operative engagement with the loop of elastic material, and a plurality of streamers attached to the streamer holder, the plurality of streamers extending radially away from the streamer holder. The present invention is further directed to a method for making the same.

15 Claims, 6 Drawing Sheets

STREAMER FLAG ATTACHMENT

RELATED APPLICATION

The present invention is related to co-pending U.S. patent application Ser. No. 29/159,475, entitled "DECORATIVE STREAMER FLAG ATTACHMENT", filed herewith.

FIELD OF THE INVENTION

The present invention relates generally to a visual display system, and more particularly to a streamer flag attachment to provide desired visually appealing or attractive enhancements to a flag pole or a flagstaff.

BACKGROUND OF THE INVENTION

Flags have been used for centuries as visually prominent displays for expressing ideas including mourning, event recognition, patriotism or solidarity to country, group, cause or organization symbolized or simply for calling the attention of others. Flags are traditionally attached along a vertical or horizontal edge to a rigid structure, such as a pole, suspended from a taught rope or suspended from the side of a building or other structure. Visually enhancing colors or standards in the forms of banners, ribbons, pennants, or streamers, for example, have also been used to adorn flags to further enhance or glorify their significance, meaning or appearance, or to supplement or complement the symbolism represented. Often, streamer type adornments are tied to the flag pole producing an unattractive impression. Streamer adornments attached in this manner are cumbersome to detach. In addition, there is a tendency for the streamer adornments to loosen and to eventually be pulled away by the wind.

Other methods of securing streamers on the flag pole have also been attempted. For example, U.S. Pat. No. 2,869,507 issued to Boyer, discloses a streamer mount for flagstaffs which comprises a flat circular member with an axial hole dimensioned for fitting onto an upper end of the flag pole whereupon the circular member is secured thereon by clamping. The circular member of the mount as disclosed by Boyer further includes a series of circumferentially spaced holes along the outer edge thereof from receiving hooks for attaching streamers. Some drawbacks of the Boyer mount include adding modifications and weight to the existing flagstaff, greater design complexity, and unappealing appearance.

It would therefore be highly desirable to provide a streamer flag attachment that overcomes the aforementioned prior art drawbacks and limitations for attaching and flying streamers, ribbons, banners, pennants and the like on a rigid structure such as a flagstaff.

SUMMARY OF THE INVENTION

According to the present invention, there are provided a streamer flag attachment and a method for making the same to create visually attractive enhancements to a flag pole or a flagstaff, for example. Preferably, the attachment includes visually appealing flag-like streamer members including tubes, ribbons, pennants, banners or the like, and means for easily securing the streamer flag attachment to a top end portion of the flag pole without prior modifications to the structure or requiring the use of tools, fasteners, brackets or mounts. The present invention provides a distinct physical appearance to the existing flag pole, while being lightweight, simple in design, and relatively inexpensive to make and implement. The present invention is further designed to withstand strong wind forces and avoid unsightly entanglements.

In the present invention, the streamer flag attachment generally comprises a circular loop comprising an elastic material with a central opening being defined therein, a sleeve-like streamer holder attached to the loop, and a plurality of elongated strips of flexible material attached to and extending radially away from a portion of the streamer holder. The user can securely mount the streamer flag attachment by coupling the circular loop around the flag pole, and allowing the loop to grip the surface of the flag pole, thus holding the streamer flag attachment in place. Optionally, the user can twist the loop over itself around the flag pole to provide a tighter and more secure grip therebetween.

In one particular aspect of the present invention, there is provided a streamer flag attachment for securement to a flag pole or a flagstaff, which comprises:

(a) a circular loop of elastic material defining a central opening for receiving therethrough an end portion of the flagstaff;

(b) a streamer holder adapted for operative engagement with the loop of elastic material; and (c) a plurality of streamers attached at one end, respectively, to the streamer holder, the plurality of streamers extending radially away from the streamer holder.

In another particular aspect of the present invention, there is provided a method of making a streamer flag attachment for securement to a flag pole or flagstaff, which comprises:

(a) forming a circular band of elastic material with a central opening, the band being configured for being pushed onto a portion of the flag pole or flagstaff through the central opening for secure retention thereon;

(b) attaching a plurality of streamers at one end, respectively, onto opposing ends of a fabric segment in a juxtaposed arrangement with one another, respectively; and (c) enclosing the fabric segment around a portion of the loop with the plurality of juxtaposed streamers at the opposed ends thereof overlapping one another, respectively.

BRIEF DESCRIPTION OF THE DRAWINGS

Various embodiments of the invention are described in detail below with reference to the drawings, in which like items are identified by the same reference designation, wherein.

DETAILED DESCRIPTION OF THE INVENTION

The present invention relates to a streamer flag attachment configured for securement to a flag pole or a flagstaff. The streamer flag attachment of the present invention is adapted for easy and secure mounting without tools, flag pole modifications, fasteners, and the like. The streamer flag attachment is simple and cost efficient to make and use, and provides a facilitated means for attaching streamers or the like to a portion of the flagstaff. The streamer flag attachment includes a circular loop comprising an elastic material for defining a central opening therein, and a sleeve-like streamer holder encasing a portion of the circular loop with a plurality of streamers of flexible material attached to and extending radially away from the streamer holder. The streamer flag attachment provides secure fastening capable of withstanding strong wind forces. The present invention also provides a method of making the same.

Figure 1:
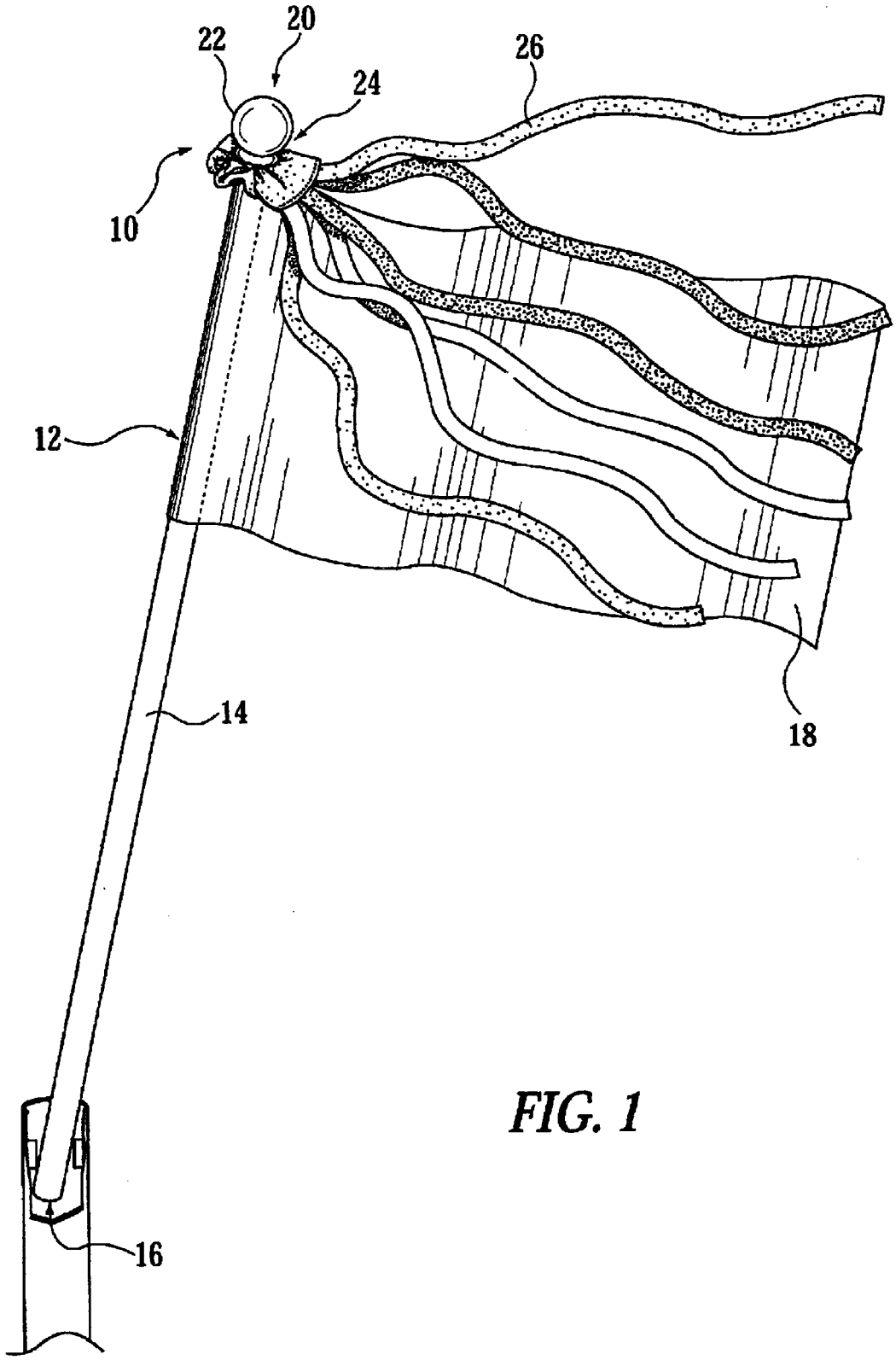
FIG. 1 is a perspective view of a streamer flag attachment secured to a flagstaff in accordance with one embodiment of the present invention.
Figure 2:
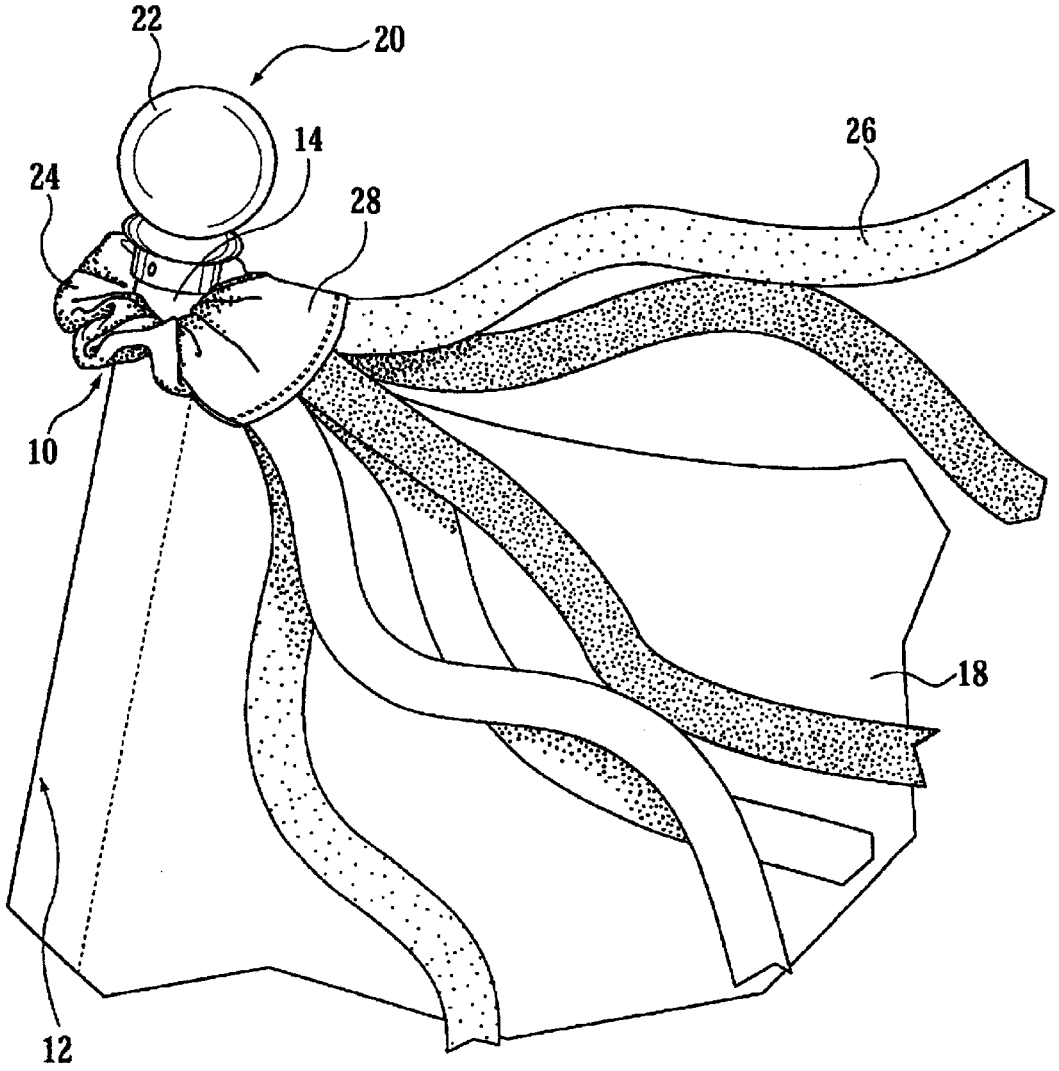
FIG. 2 is an enlarged view of the upper end portion of the flagstaff with the streamer flag attachment secured thereto in accordance with the present invention.
Figure 3:
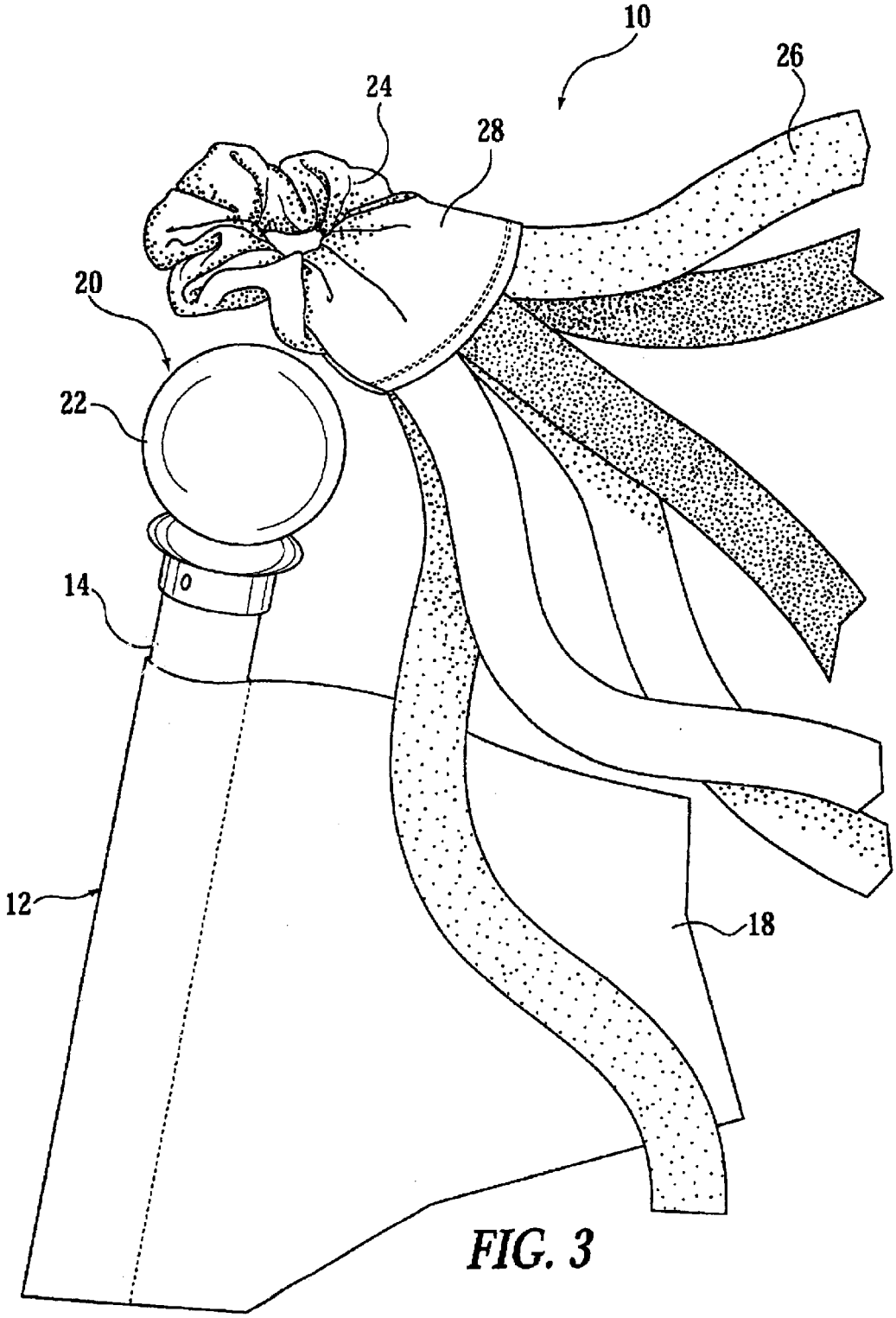
FIG. 3 is an enlarged view of the upper end portion of the flagstaff with the streamer flag attachment apart therefrom in accordance with the present invention.

With reference to FIGS. 1 to 3, a streamer flag attachment, designated by the reference numeral 10, is shown in operative combination with a flagstaff 12 in accordance with the present invention. The flagstaff 12 includes a pole 14 secured by a base 16, and a primary flag 18 attached proximate the upper end 20 of the pole 14. The pole 14 can be made from a single or separate sections of suitable tubing or rod material. The pole 14 can be made from a suitable material selected from metals, woods, plastics, composite materials such as fiberglass, and the like. The flagstaff 12 can further include an ornamental piece 22 secured at the upper end 20 of the pole 14 through suitable means as known in the art.

The streamer flag attachment 10 of the present invention includes a circular loop 24 comprising an elastic material, and a plurality of streamers 26 secured to a side portion of the elastic loop 24 via a sleeve-like streamer holder or sleeve 28 as further described in detail below. Each of the plurality of streamers 26 are juxtaposed to one another to avoid attaching the ends of the streamers 26 at a single common point. This arrangement allows the streamers 26 to be smoothly unfurled by the wind for a greater visual effect, and to minimize undesirable entanglements of the streamers 26. The juxtaposed streamers 26 are further arranged in a plurality of overlapping layers which serve to further enhance the visual effect.

The term "streamers" as used herein, is meant to include not only elongated rectangular streamers or flag-like streamer members, but also two or three-dimensional elongated displays of different geometric shapes, such as triangular pennants, banners, tubes, ribbons, standards, and the like. The streamers can be in any geometric shape, but rectangular is preferred. In the preferred embodiment as shown in the figures, the streamers 26 can be uniformly single-colored or multi-colored, respectively, and can optionally include indicia, designs, patterns and the like, applied thereon. The streamers 26 are preferably made of a thin flexible material including, but not limited to, fabrics such as nylon, cotton, papers, metals, plastic polymers and combinations thereof. When the streamers 26 are black, the streamer flag attachment 10 can serve alone as a form of a mourning flag or draped over a primary flag near the top of the flagstaff for the purposes of displaying the mourning state.

In the present invention, the sleeve 28 includes a substantially tubular form that extends along and encompasses a portion of the elastic loop 24. The length of the sleeve 28 can vary depending on the number, width and arrangement of the streamers 26 attached thereto. The sleeve 28 provides an attachment means between the elastic loop 24 and the streamers 26 and facilitates hinge-like movement to minimize the incidence of wear and tear therebetween. The details of the assembly of the sleeve 28 with the streamers 26 and the elastic loop 24 are described below.

Figure 4:
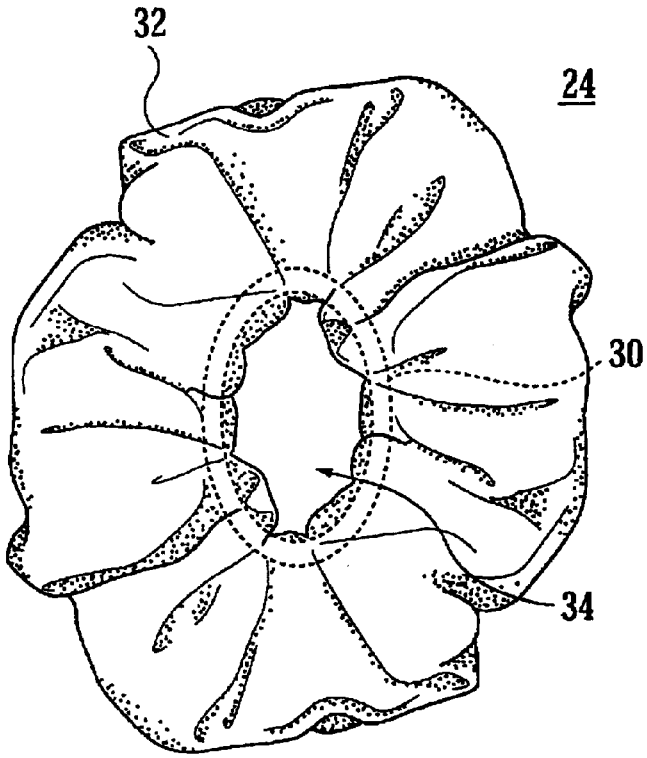
FIG. 4 is an elevational view of an elastic loop having a ruffled covering or shell in accordance with the present invention.

As best shown in FIGS. 2 and 4, the elastic loop 24 defines an opening 34 through which the flag pole 14 extends during mounting. The elastic loop 24 is adapted to bias radially inward around the opening 34 for affording a snug fit around the flag pole 14. The elastic loop 24 can be positioned above the primary flag 18 with the streamers 26 depending therefrom, so as to present an attractive or prominent appearance. The elastic loop 24 provides secure attachment while permitting limited rotational movement to allow the streamer flag attachment 10 to pivot with the wind, thereby preventing the streamers 26 from being entangled with the flag pole 14 or the primary flag 18. To remove the streamer flag attachment 10, the user can simply pull the elastic loop 24 off from the flag pole 14.

With reference to FIG. 4, the elastic loop 24 includes an outer shell or covering 32 and an elastic band 30 (shown in phantom) composed of a suitable material such as rubber, latex, and/or spandex, for example, and located within the covering 32. The covering 32 is preferably composed of fabric or other suitable material generally in the form of a toroid, and is adapted to surround and at least substantially encompass the entire circumference of the elastic band 30. In the preferred embodiment, the covering 32 is formed by a length of tubular fabric material extending along the circumference of the elastic band 30 and stitched closed to completely encase the band 30. The covering 32 is preferably longer than the band 30 to form ruffles as shown best in FIG. 4. The accordion-like or ruffled construction of the covering 32 permits the elastic band 30 to resiliently expand and contract, while providing a decorative appearance and a pleasing visual effect for the streamer flag attachment 10. The covering 32 can be made of any flexible material including, but not limited to, nylon, linen, and/or cotton, for example.

Figure 5:
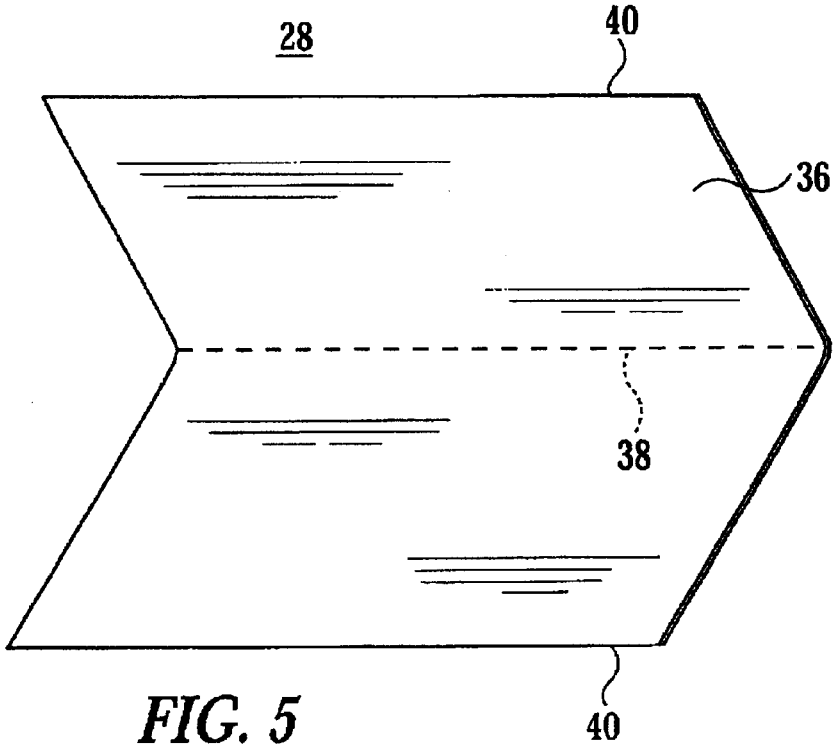
FIG. 5 is a top plan view of a streamer holder in accordance with the present invention.

Referring to FIG. 5, the sleeve 28 is generally formed by a rectangular fabric segment 36 composed of a fabric material. The fabric segment 36 includes outer peripheral edge portions 40 extending along the opposed ends thereof, respectively, and a centrally-located fold line 38. The sleeve 28 can be formed by bending the fabric segment 28 along the fold line 38 and causing the opposed peripheral edge portions 40 to come into contact. Prior to forming the sleeve 28, the streamers 26 can be attached to the fabric segment 36 through suitable methods as described below.

Figure 6:
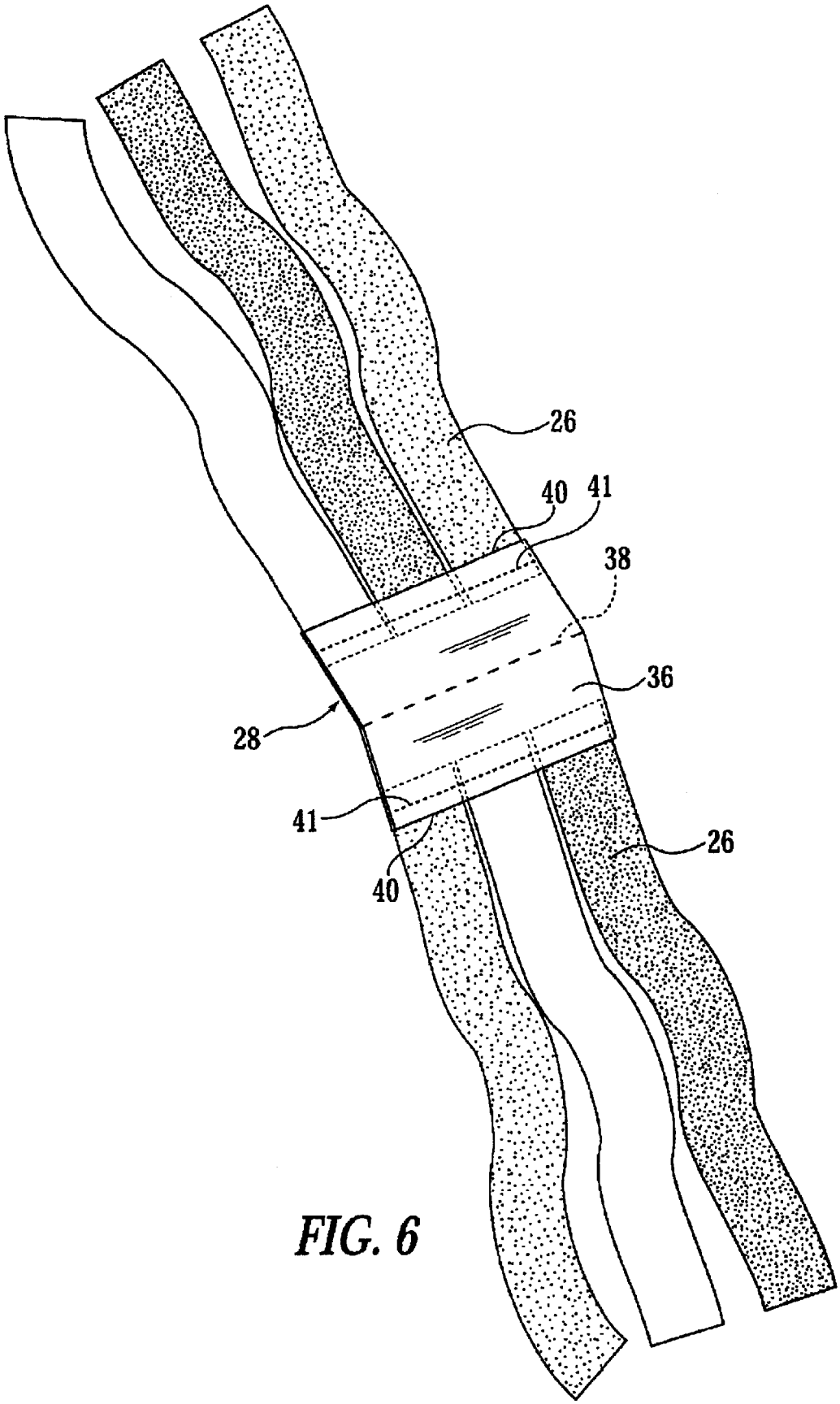
FIG. 6 is an elevational view of a streamer holder assembly in accordance with the present invention.

Referring to FIG. 6, the end of each streamer 26 is positioned at the peripheral edge portions 40, respectively, so that the streamers 26 are arranged in juxtaposition with one another. The ends of the streamers 26 are sewn to the fabric segment 36 along respective stitch lines 41. Alternatively, the streamers 26 can be attached to the fabric segment 36 through other suitable means such as through adhesives. Thereafter, the assembled streamers 26 and fabric segment 36 can be secured to the elastic loop 24 as described below.

Figure 7:
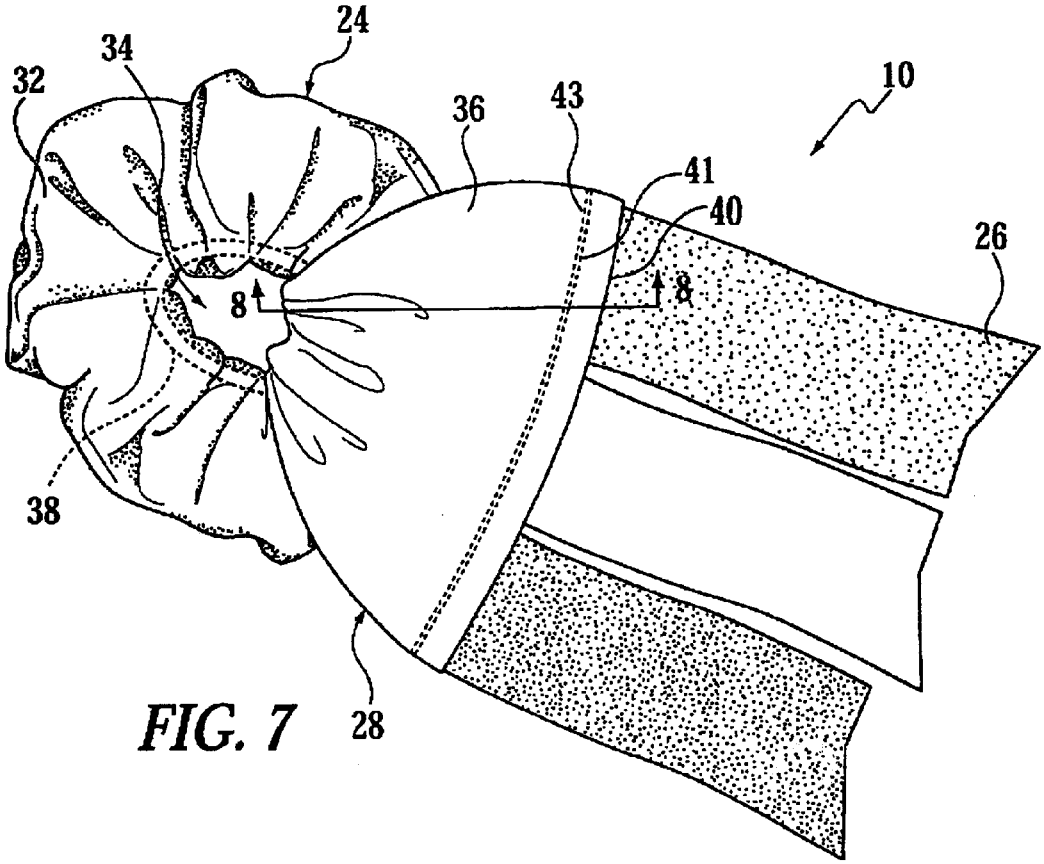
FIG. 7 is a top plan view of the assembled streamer flag attachment of the present invention.
Figure 8:
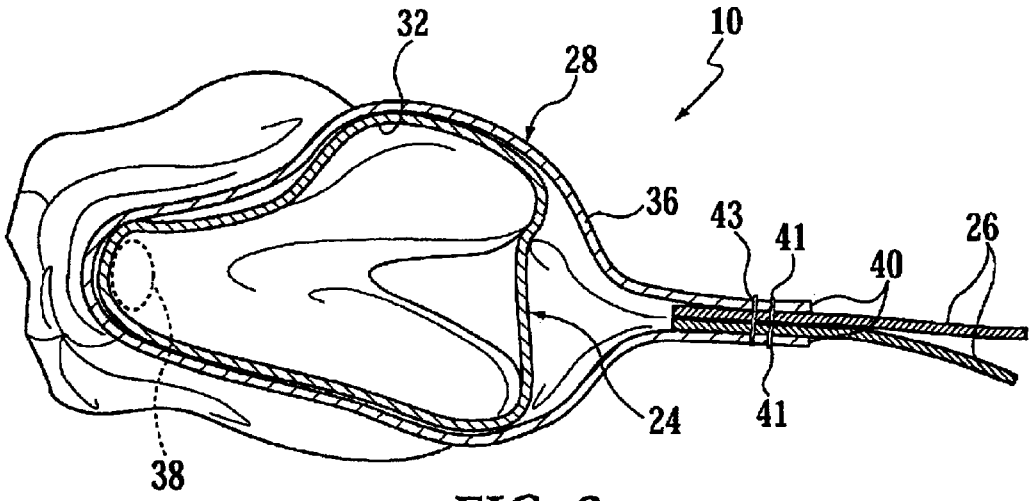
FIG. 8 is a cross sectional view taken along 8—8 of FIG. 7.

Referring to FIGS. 7 and 8, the assembled streamers 26 and fabric segment 36 are inserted through the loop opening 34 with the fold line 38 of the segment 36 level with the plane of the loop 24. The fabric segment 36 is folded over a portion of the loop 24 in a manner to cause the streamers 26 to come into contact and overlap with the opposing ones, respectively, as shown in FIGS. 2 and 3. The peripheral edge portions 40 and the respective overlapping ends of the streamers 26 are sewn together along a stitch line 43 which extends substantially parallel with the stitch lines 41 and the peripheral edge portions 40. It is noted that the peripheral edge portions 40 of the fabric segment 36 and the sewn ends of the streamers 26 can be secured to one another, respectively, through other suitable means including adhesives, fasteners, and the like. As shown in FIG. 8, the fabric segment 36 completely surrounds the portion of the loop 24 and is secured by the stitch line 43 sewn through the peripheral edge portions 40 thereof and the overlapping juxtaposed streamers 26 secured to the peripheral edge portions 40.

With reference to FIGS. 1 to 3, the operation of the streamer flag attachment 10 is described. With specific reference to FIG. 3, the streamer flag attachment 10 is slipped over the ornamental piece 22. The elastic loop 24 is held in place by the elastic forces radially biased inward by the elastic loop 24. Optionally, the user can fold the elastic loop 24 over onto itself by forming a figure eight and slipping the new loop over the ornamental piece 22 to yield a tighter grip therearound.

Although various embodiments of the invention have been shown and described, they are not meant to be limiting. Those of skill in the art may recognize various modifications to these embodiments, which modifications are meant to be covered by the spirit and scope of the appended claims.

What is claimed is:

1. A streamer flag attachment for securement to a flag pole or a flagstaff, comprising:

(a) a loop comprising an elastic material formed into a closed ring defining a central opening for receiving therethrough a portion of the flag pole, said ring having an inner diameter sufficient to encompass and fit snugly around the circumference of the flag pole;

(b) a thin flexible sleeve-like streamer holder wrapped around and partially surrounding only a portion of the ring; and (c) a plurality of streamers of flexible materials permanently attached to and extending only radially away from the sleeve-like streamer holder.

2. The streamer flag attachment of claim 1, wherein the color of the plurality of streamers is selected from a group consisting of a single color, multiple colors, and solid colors.

3. The streamer flag attachment of claim 1, wherein the plurality of streamers are attached in a juxtaposed configuration.

4. The streamer flag attachment of claim 3, wherein each one of the plurality of juxtaposed streamers further includes a plurality of overlapping elongated strips of material, respectively.

5. The streamer flag attachment of claim 1, wherein the loop further comprises:

a circular elastic band; and a covering extending and surrounding along the circumference of the circular elastic band.

6. The streamer flag attachment of claim 5, wherein the covering is composed of a fabric material.

7. The streamer flag attachment of claim 5, wherein the covering further comprises a plurality of ruffles.

8. The streamer flag attachment of claim 1, wherein the plurality of streamers are selected from the group consisting of pennants, ribbons, banners, standards, tubes, and combinations thereof.

9. The streamer flag attachment of claim 1, wherein the flexible material is selected from the group consisting of fabrics, polymers, papers, metals, and combinations thereof.

10. The streamer flag attachment of claim 1, wherein:

said streamer holder being formed from a single piece of material folded in half with free ends opposing one another; and said plurality of streamers each having end portions rigidly attached to inside edge portions of the free ends of said streamer holder, the free ends of said streamer holder being secured together.

11. A method for making a streamer flag attachment for securement on a flag pole or a flagstaff, comprising:

(a) forming a circular band of elastic material with a central opening, said circular band having an inner diameter sufficient to encompass and fit snugly around the circumference of the flag pole, whereby the band is configured for being pushed onto a portion of the flag pole or flagstaff through the central opening for secure retention thereon;

(b) attaching a plurality of streamers at one end, respectively, onto opposing ends of a fabric segment in a juxtaposed arrangement with one another, respectively;

(c) enclosing the fabric segment around and partially surrounding only a portion of the loop with the plurality of juxtaposed streamers at the opposing ends thereof overlapping one another, respectively, said streamers extending only radially away from the fabric segment; and (d) securing the opposing ends of the fabric segment and streamers together.

12. The method of claim 11, further comprising surrounding the elastic band along the circumference thereof with a covering having a plurality of ruffles.

13. The method of claim 11, wherein step (b) further comprises sewing the plurality of streamers to the opposed ends of the fabric segment.

14. The method of claim 11, wherein step (d) further comprises sewing the opposing ends of the fabric segment and the overlapping ends of the plurality of juxtaposed streamers together.

15. The method of claim 11, further comprising forming each one of said plurality of juxtaposed streamers from a plurality of elongated strips of material.

* * * * *